US007604555B2

(12) United States Patent
Nye

(10) Patent No.: US 7,604,555 B2
(45) Date of Patent: Oct. 20, 2009

(54) BASKETBALL RIM ASSEMBLY

(75) Inventor: S. Curtis Nye, Clinton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 42 days.

(21) Appl. No.: 11/679,748

(22) Filed: Feb. 27, 2007

(65) Prior Publication Data

US 2007/0213148 A1 Sep. 13, 2007

Related U.S. Application Data

(60) Provisional application No. 60/777,202, filed on Feb. 27, 2006.

(51) Int. Cl.
*A63B 63/08* (2006.01)

(52) U.S. Cl. ..... 473/486

(58) Field of Classification Search ..... 473/485, 473/479–486; D21/701, 702, 703
See application file for complete search history.

(56) References Cited

U.S. PATENT DOCUMENTS 4,798,381 A * 1/1989 Dadbeh ..... 473/484
5,564,694 A * 10/1996 Bowman ..... 473/486
5,730,667 A * 3/1998 Jones ..... 473/447
6,186,911 B1 * 2/2001 Manthey ..... 473/486
6,503,160 B2 * 1/2003 Hehr ..... 473/486
6,881,162 B2 * 4/2005 Nye et al. ..... 473/481
7,048,655 B2 5/2006 Nye et al.
7,195,571 B2 3/2007 Nye
2003/0054906 A1 * 3/2003 Allshouse et al. ..... 473/486

* cited by examiner

*Primary Examiner*—Gene Kim
*Assistant Examiner*—M Chambers
(74) *Attorney, Agent, or Firm*—Workman Nydegger

(57) ABSTRACT

A basketball goal system may include a rim assembly that forms part of a breakaway rim that can deflect downwardly when a force larger than a predetermined amount is applied to the rim. The basketball goal system may include a biasing member, which may be sized and configured to bias the rim assembly from a deflected position to its previous playing position. The basketball goal system may include a rim mounting bracket, which may be sized and configured to connect the rim assembly to a mounting surface, such as a backboard or a basketball goal support structure. The basketball goal system may also include pivot bracket and a connector that may be sized and configured to interconnect the biasing member, the pivot bracket and the rim assembly. The rim mounting bracket may be movable between a storage position and a use position.

21 Claims, 9 Drawing Sheets

BASKETBALL RIM ASSEMBLY

CROSS-REFERENCE TO RELATED APPLICATIONS

This application claims priority to and the benefit of U.S. provisional patent application Ser. No. 60/777,202, entitled Basketball Rim Assembly, which was filed on Feb. 27, 2006, and is hereby incorporated by reference in its entirety.

BACKGROUND OF THE INVENTION

1. Field of the Invention

The present invention generally relates to basketball systems and, in particular, to a basketball rim assembly.

2. Description of Related Art

The game of basketball is played by many people throughout the United States and the world. Briefly, the game of basketball typically includes a flat and level playing surface with a basketball goal at each end of the court. The basketball goal, which usually includes a backboard and a hoop or rim, is often attached to the top of a support pole. The basketball hoop is normally located ten feet above the playing surface and the backboard is often constructed from materials such as wood, plastic or tempered glass.

Conventional basketball goals often include rigidly mounting the hoop to the basketball backboard so that the face of the backboard is positioned perpendicular to the playing surface and the hoop is positioned parallel to the playing surface. The mounting of the hoop to the backboard must be sufficiently rigid so that the hoop remains in a generally stationary position and parallel to the playing surface. In addition, the hoop must be securely attached to the backboard so that the hoop is capable of withstanding various forces and impacts during the game of basketball. For example, the hoop must remain in a generally stationary position and parallel to the playing surface so that the basketball rebounds and bounces off the rim in a consistent, dependable manner.

In addition, the hoop must be able to withstand various impacts during the game. For example, in recent years it has become increasingly popular for players to "dunk" the basketball by throwing the basketball through the hoop with great force. In particular, when "dunking" the basketball, the player throws the basketball through the hoop from a position above the rim, often with significant force and velocity. While it is possible to dunk the basketball without the basketball or the player touching the hoop, it is not uncommon for the player to strike the rim with the basketball and/or his or her hands and arms while dunking the basketball. The player may also momentarily grab or hang onto the hoop while dunking the basketball. Additionally, players may occasionally hold or suspend themselves from the hoop to prevent them from falling, to regain their balance and/or to prevent them from landing on another player. These forces caused by dunking the basketball and players grabbing the hoop are often substantial.

If the force applied to the basketball hoop is excessive, then many problems could result. For example, the hoop may be bent such that it is no longer parallel to the playing surface. This is very undesirable because if the hoop is not horizontal and parallel to the playing surface, then the basketball will not bounce or rebound consistently or correctly. After a hoop has been bent into a deformed position, it is very difficult, if not impossible, to restore the hoop to its original, horizontal position. Thus, the hoop must usually be replaced, which is often time consuming and difficult to accomplish. Further, because hoops used in connection with home, playground and portable basketball systems are often not as strong and durable as hoops used for professional basketball systems, these hoops are more likely to be bent and deformed. Therefore, these types of hoops may be more likely to be damaged and in need of replacement.

Additionally, if excessive force is applied to the hoop, then the backboard may be damaged or broken. For example, if the backboard is constructed from tempered glass, then the glass may shatter. The backboard may also be constructed from other materials, such as plastic, that may also be damaged or broken if too much force is applied to the hoop. Disadvantageously, if the backboard is damaged or broken, then it may be very difficult or impossible to repair. Thus, the entire backboard may have to be replaced, which may be time consuming and expensive.

In order to help prevent the hoop and backboard from being damaged, it is known to use a basketball hoop that will "breakaway" or deflect from its original horizontal position to an angled or deflected position when a force greater than a predetermined amount is applied to the hoop. In particular, when a force greater than the predetermined amount is applied to the hoop, the rim may be allowed to pivot downwardly before the rim or backboard is damaged. These known breakaway rims allow the hoop to maintain its horizontal position during regular play when forces, such as a basketball bouncing off the hoop, are applied. The breakaway rims, however, deflect downwardly when a substantial amount of force is applied to the hoop, such as when a player dunks a basketball or grabs the rim.

Known breakaway rims, however, are often rather complex structures that include multiple parts. In addition, many conventional breakaway rims require a relatively large amount of space to store the various parts and components. In particular, many conventional breakaway rims have relatively large-sized parts that require a significant amount of storage space. For instance, many conventional breakaway rims include an enclosure that encloses various parts and components. The enclosure, which may have a size that is significantly larger than the other components of the breakaway rim, may significantly increase the amount of storage space. Because conventional breakaway rims often require a large amount of storage space, they may also require a relatively large amount of space for packaging. The relatively large sized packaging may significantly increase shipping costs.

Because many conventional basketball rim assemblies include multiple components and require a relatively large amount of space, they may be quite expensive to manufacture and ship, which may result in an increased price to the consumer. In addition, many conventional breakaway rim assemblies are often relatively difficult and time consuming to assemble because, for example, of the multiple parts and components. Because many consumers lack the ability and/or the time required to assemble these conventional breakaway rim assemblies, manufacturers often ship the rim assemblies in a completely assembled configuration. This may undesirably increase the cost of manufacturing and shipping because of the extra time required to assemble the breakaway rim assemblies and the completely assembled rim assemblies typically take up more space, making them less efficient to ship and store.

BRIEF SUMMARY OF THE INVENTION

A need therefore exists for a basketball system that eliminates or diminishes the disadvantages and problems described above.

One aspect is a basketball goal that may help support a basketball rim above a playing surface. The basketball goal desirably supports the rim such that it is generally parallel to the playing surface. The basketball goal may also allow the rim to pivot or move when a large force is applied to the rim.

Another aspect is the basketball goal that may be part of a system that includes features such as a basketball backboard, a support structure that is sized and configured to help support the basketball goal at a desired height, and/or a height adjustment mechanism that allows the height of the basketball goal to be adjusted. Advantageously, the basketball goal can include all or only a few of these features depending, for example, upon the intended use of the basketball goal.

Yet another aspect is the basketball goal may include a breakaway rim that allows pivotal movement or deflection of the rim in response to an impact, load or force applied to the rim. In particular, the breakaway rim may be normally in a horizontal position and parallel to the playing surface when playing basketball, but the rim can deflect downwardly to absorb significant impacts or forces on the rim and that may help prevent injury to players and/or damage to the rim or backboard. Advantageously, the breakaway rim may have the feel and characteristics of a fixed, stationary rim, but it can pivot or deflect downwardly when a force larger than a predetermined amount is placed on the rim.

Still another aspect is the basketball goal that may include a resistance mechanism that helps maintains the rim in its normal position while playing basketball, but also allows the rim to deflect when a force exceeding a certain amount is applied to the rim. The resistance mechanism may also be used to help return the rim to its original position after it has been deflected.

Still yet another aspect is a basketball goal that may include a breakaway rim and a biasing member which is sized and configured to bias the rim into a desired position. For example, the biasing member may be sized and configured to bias the rim from the displaced position to the playing position. The biasing member may include one or more springs, such as compression springs, extension springs, torsion springs, leaf springs, gas springs and the like. The biasing member may also consist of other structures that are sized and configured to bias the rim into a particular position.

A further aspect is a basketball goal that may include a mounting system that is sized and configured to a backboard and/or support structure. The mounting system may include a mounting bracket and a housing that can be quickly and easily divided into two or more pieces, which may decrease the required size of the packaging and/or the amount of spaced required for shipping the basketball goal. Desirably, the pieces of the mounting bracket and housing can be quickly and easily connected and assembled. This may allow, for example, the basketball goal to be shipped in two or more pieces and subsequently assembled, for example, by the retailer or consumer. In addition, this may allow the basketball goal to be shipped in a relatively flat or thin package.

A still further aspect is a basketball goal that may include a mounting bracket that is movable between a storage or shipping position and a use position. For example, the mounting bracket may include first and second portions that are movable between the shipping and use positions. In greater detail, the mounting bracket may include right and left portions that are movable between the shipping and use positions. This may allow the mounting bracket to be shipped and stored in a relatively compact configuration. The mounting bracket may also be used to create a strong and durable basketball goal.

Yet another further aspect is a basketball goal that may include a rim, a rim extension, a housing and a mounting bracket. The rim may be movable relative to the mounting bracket to create a breakaway rim. In addition, the mounting bracket may be at least partially disposed within the housing and the rim extension may be pivotally connected to the mounting bracket. The rim extension may also be connected to the mounting bracket by a resilient member, such as a spring, to create the breakaway rim.

Another aspect is a basketball goal that may include a rim and a rim brace. The rim brace is preferably securely connected to the rim and the rim brace may help support the rim. In addition, the rim brace may advantageously increase the strength and/or stability of the rim. In addition, the rim brace may allow significant forces and/or impacts to be applied to the rim.

Still another aspect is a basketball goal that may include a mounting bracket which is sized and configured to mount the rim assembly to a structure such as the backboard or support structure. The mounting bracket may also be sized and configured to connect the rim assembly to other suitable portions of the basketball system.

Still yet another aspect is a basketball goal that may include a housing that is sized and configured to at least partially cover, protect, support and/or prevent contact with at least a portion of the basketball goal, such as the biasing member. The housing may also be sized and configured to allow the basketball goal to be attached to a structure such as the backboard or support structure.

A further aspect is a basketball goal that may include a plurality of components that are sized and configured to be packaged in an at least partially unassembled configuration. Advantageously, this may allow the basketball goal to be disposed within smaller packaging than conventional basketball goals, which may make storage and shipping more efficient. In addition, these components are desirably sized and configured to be quickly and easily assembled. Advantageously, this may allow a retailer or purchaser to at least partially assemble the basketball goal, which may reduce assembly and/or manufacturing costs.

A still further aspect is a basketball goal that may include a rim assembly, a mounting bracket, a pivot bracket and a biasing member. The rim assembly is preferably pivotally connected to the mounting bracket and the pivot bracket is preferably pivotally connected to the mounting bracket. The pivot bracket is also preferably connected to the rim assembly. In particular, the pivot bracket is preferably connected to the rim assembly by a connector and a biasing member. The biasing member is preferably sized and configured to help maintain the rim in the playing position and allow the rim to be disposed in the displaced position. The biasing member is also preferably sized and configured to help return the rim from the displaced position to the playing position. Because the pivot bracket is preferably pivotally connected to the mounting bracket, the pivot bracket, biasing member and connector may each move as the rim moves between the displaced and playing positions. Advantageously, this may significantly reduce the stresses applied to the pivot bracket, biasing member and/or connector, which may help prevent these and other components of the basketball goal from being bent, broken or damaged.

Advantageously, the basketball goal may be relatively uncomplicated, cost effective and easy to manufacture. Further, the basketball goal may have a rather straight-forward design and it may be simple to maintain because it has few parts. In addition, the basketball goal may be used with different types of basketball systems, such portable basketball systems or systems that are designed to be fixed in a desired location.

Significantly, the basketball goal may also have a relatively small and compact design. In addition, the basketball goal may be easily assembled and disassembled by the manufacturer or customer. These features may decrease shipping and transportation costs. Further, the small and compact size of the basketball goal may allow a basketball system with a pleasing appearance and design to be created.

These and other aspects, features and advantages of the present invention will become more fully apparent from the following detailed description of preferred embodiments.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a basketball goal. The principles of the present invention, however, are not limited to a basketball goal. It will be understood that, in light of the present disclosure, the basketball goal disclosed herein can be successfully used in connection with other types of basketball and sporting equipment.

Additionally, to assist in the description of the basketball goal, words such as top, bottom, front, rear, right and left may be used to describe the accompanying figures, which are not necessarily drawn to scale. It will be appreciated, however, that the rim assembly can be located in a variety of desired positions—including various angles, sideways and even upside down.

It will also be appreciated that the basketball goal can be used in connection with different types of basketball systems and the basketball systems may have various shapes, sizes, arrangements and configurations. For example, the basketball goal may be used with basketball systems that include a support structure, such as a support pole, that is sized and configured to maintain the basketball goal at a desired height above a playing surface. The basketball goal may also be part of a portable basketball system, which may include a base with a hollow interior portion that is sized and configured to receive ballast, such as sand or water. The portable basketball system may allow the basketball goal to be located in a plurality of desirable positions. The basketball goal could also be used in connection with other types of basketball systems, including systems that are intended to be permanently fixed in a particular location. Various aspects, features and embodiments of basketball systems that may be used in conjunction with the basketball goal are disclosed in U.S. Pat. Nos. 5,836,838; 5,947,847; 6,027,418; 6,432,003; 6,656,065 and 6,916,257; and each of these patents are incorporated by reference in their entireties.

It will further be appreciated that the basketball goal can include all or only some of the features disclosed in the accompanying figures, and the basketball goal may have different shapes, sizes, arrangements and/or configurations depending, for example, upon the type of basketball system intended to be used in connection with the basketball goal. For example, the basketball goal and/or the basketball system may include one or more aspects, features, embodiments, arrangements and/or configurations such as disclosed in U.S. Pat. Nos. 4,781,375; 4,805,904; 5,324,027; 4,881,734; 5,695,417; 5,879,247; 6,077,177; 6,120,396; 6,142,891; 6,155,938; 6,273,834; 6,419,598; 6,422,957; 6,402,644; and 6,419,597; and each of these patents are incorporated by reference in their entireties.

Figure 1:
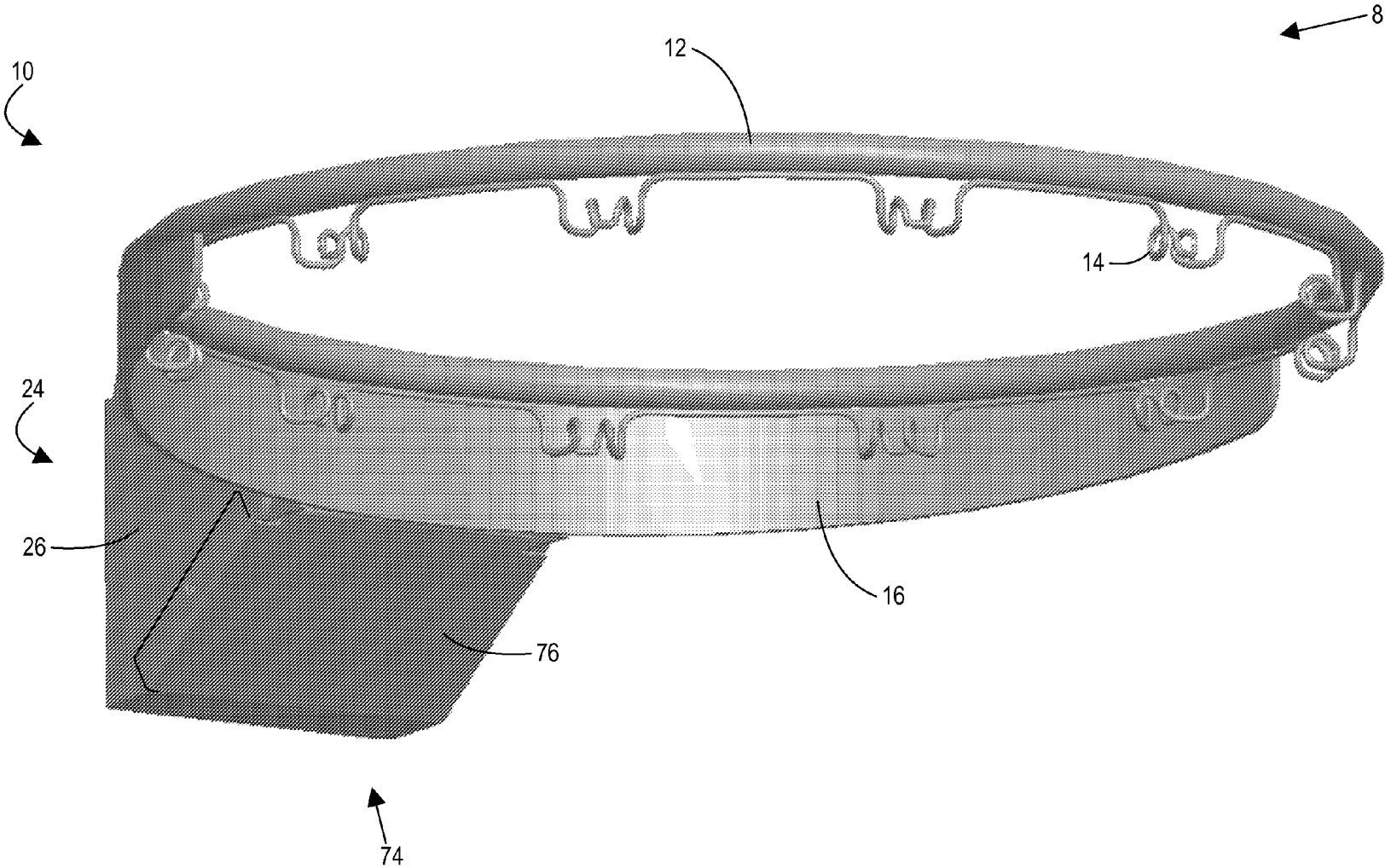
FIG. 1 a perspective view of an exemplary basketball goal.
Figure 2:
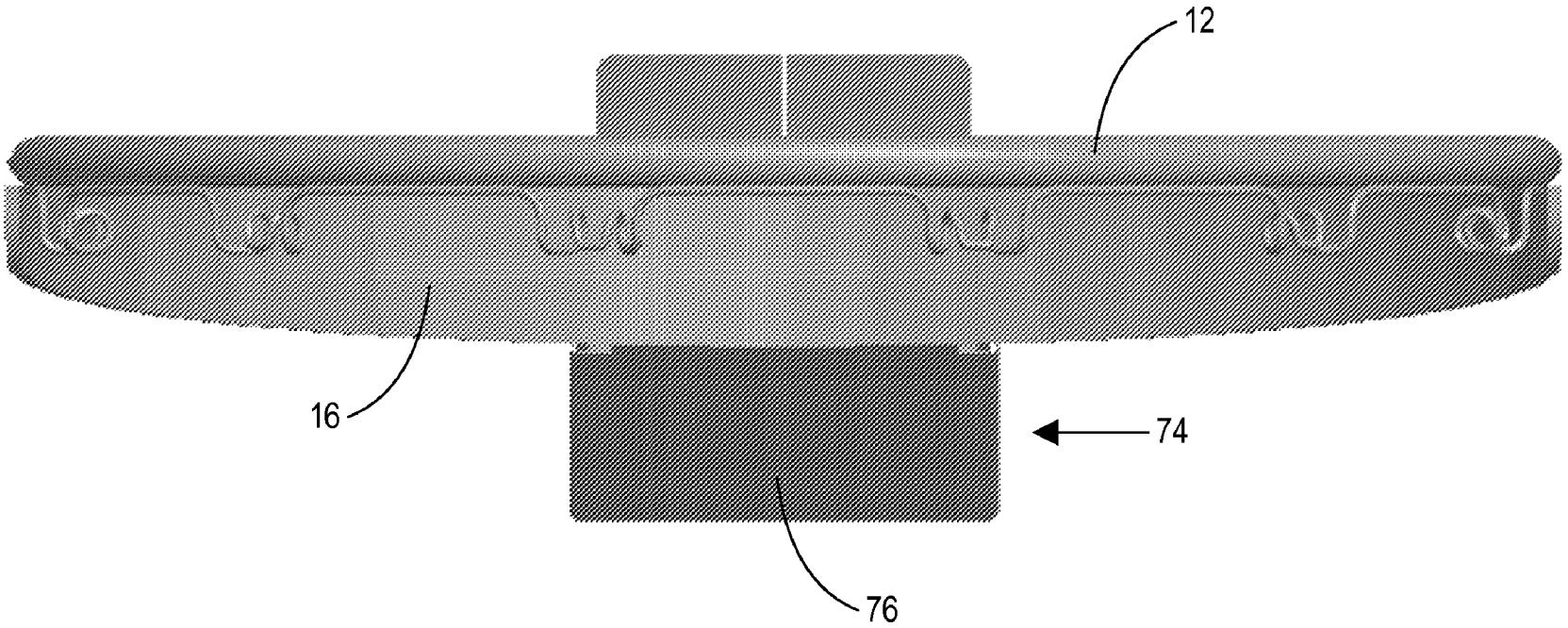
FIG. 2 is a front view of the basketball goal.

As shown in FIG. 1, a basketball goal 8 may include a basketball rim assembly 10 including a rim 12 and one or more net hooks 14 that are sized and configured to allow a net to be connected to the rim. As shown in the accompanying figures, the net hooks 14 may be constructed from a single component that is securely connected to the rim 12, but the net hooks may also consist of multiple components that are individually or collectively connected to the rim.

As discussed in more detail below, the rim 12 is preferably a movable or breakaway type rim that is sized and configured to move between a normal, playing position and a displaced or deflected position in response to a force being applied to the rim. When the rim 12 is in the playing position, the rim is preferably disposed generally parallel to the playing surface. On the other hand, when the rim 12 is in the displaced position, the rim is preferably disposed at an angle to the playing surface. The rim 12 preferably returns to the playing position when the force being applied to the rim is removed.

As shown in FIG. 1, the rim 12 may include a rim brace 16 and the rim brace may help increase the strength and/or rigidity of the rim, which may help prevent the rim from being bent or damaged. In addition, the rim brace 16 may help facilitate connection of the rim 12 to a support structure such as a backboard or basketball goal support structure. As shown in the accompanying figures, the rim brace 16 may be connected to a lower portion of the rim 12. In addition, the rim brace 16 is preferably securely and permanently connected to the rim 12 by welding, but the rim brace and rim could be connected in other suitable arrangements. Further, the rim brace 16 is preferably connected to a rear portion of the rim 12 and the rim brace may extend approximately half way around the circumference of the rim.

The rim 12 and rim brace 16 are preferably constructed from relatively strong and durable materials, such as metal or steel, which may help prevent the rim and rim brace from being bent or damaged. The rim 12 and rim brace 16, however, could be constructed from other materials with suitable characteristics and it will be appreciated that the rim and rim brace may have other suitable configurations and arrangements. For example, the rim brace 16 could consist of two elongated rods or bars that are connected to opposing sides of the rim 12, the rim brace could extend around all or substantially all of the circumference of the rim, or the rim brace could only be connected to a relatively small portion of the rim. It will also be appreciated that the rim brace 16 may not be required depending, for example, upon the intended use, configuration and/or arrangement of the basketball rim assembly 10 and/or rim 12.

Figure 3:
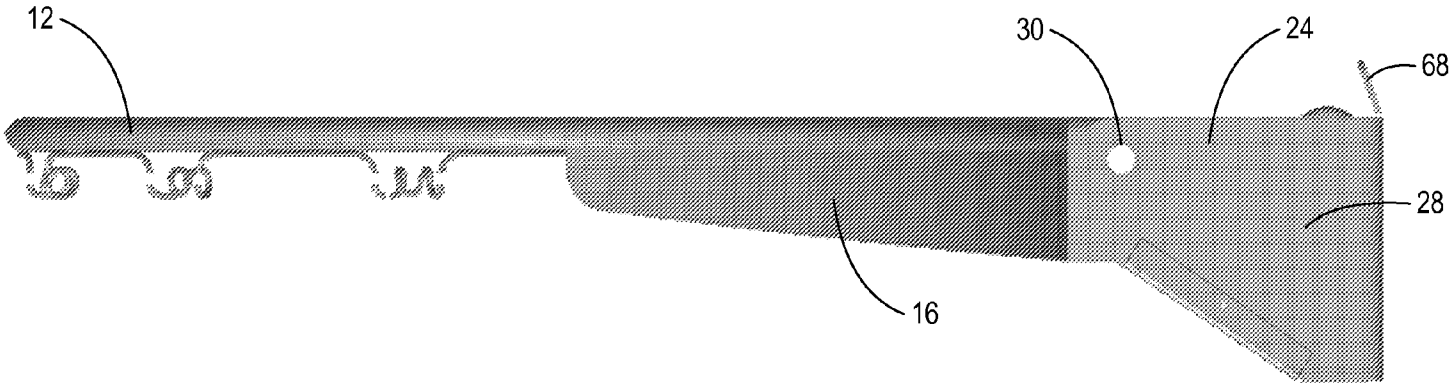
FIG. 3 is a right side view of the basketball goal.
Figure 4:
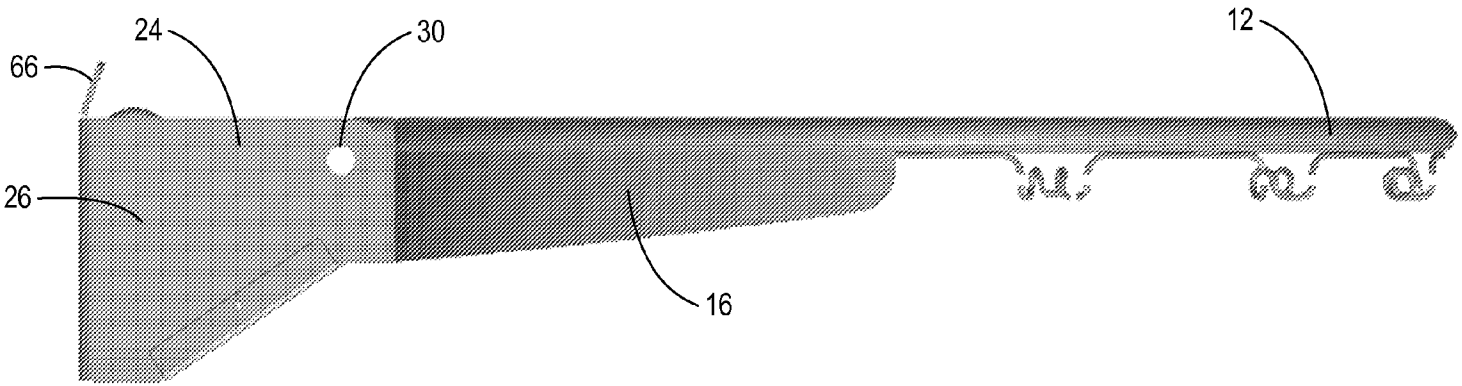
FIG. 4 is a left side view of the basketball goal.

In greater detail, the rim 12 preferably consists of a tubular piece of metal with a height or thickness, and the rim brace 16 may also have a height. The combined height of the rim 12 and rim brace 16 may compose an overall height of the rim and rim brace. For example, the rim 12 may have a thickness of about 0.6 inches and the rim brace 16 may have a height of about 2 inches. Thus, the rim 12 and rim brace 16 may have an overall height of about 2.6 inches when the rim and rim brace are connected. As discussed in more detail below, the combined height of the rim 12 and rim brace 16 may be generally equal to or larger than the height of any other components of the basketball goal 8 when the basketball goal is in a shipping or storage configuration. Advantageously, this may significantly decrease the size of the packaging or required storage space of the basketball goal 8 because the height of the packaging or storage space may be generally equal to the combined height of the rim 12 and rim brace 16. For example, the assembled basketball goal 8 shown in FIGS. 3 and 4 may have a height of about 5.6 inches, yet the basketball goal in the shipping configuration may have a height of about 2.6 inches, representing a height reduction of more than 50%. It will be appreciated, however, that the heights of the rim 12, the rim brace 16 and the basketball goal 8 may be larger or smaller depending, for example, upon their particular configurations.

Figure 5:
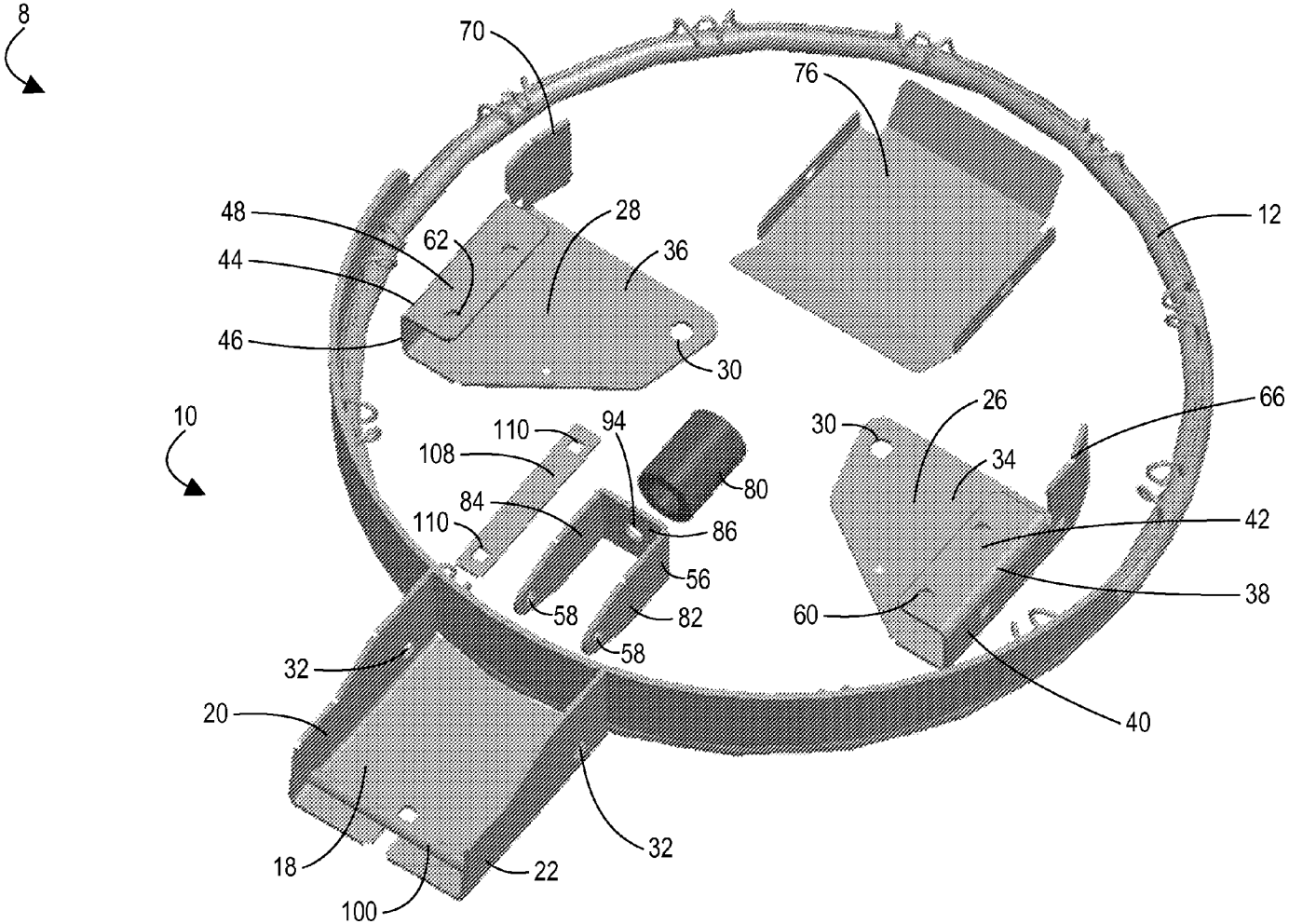
FIG. 5 is a perspective view of the basketball goal, illustrating the basketball goal in a disassembled configuration.
Figure 6:
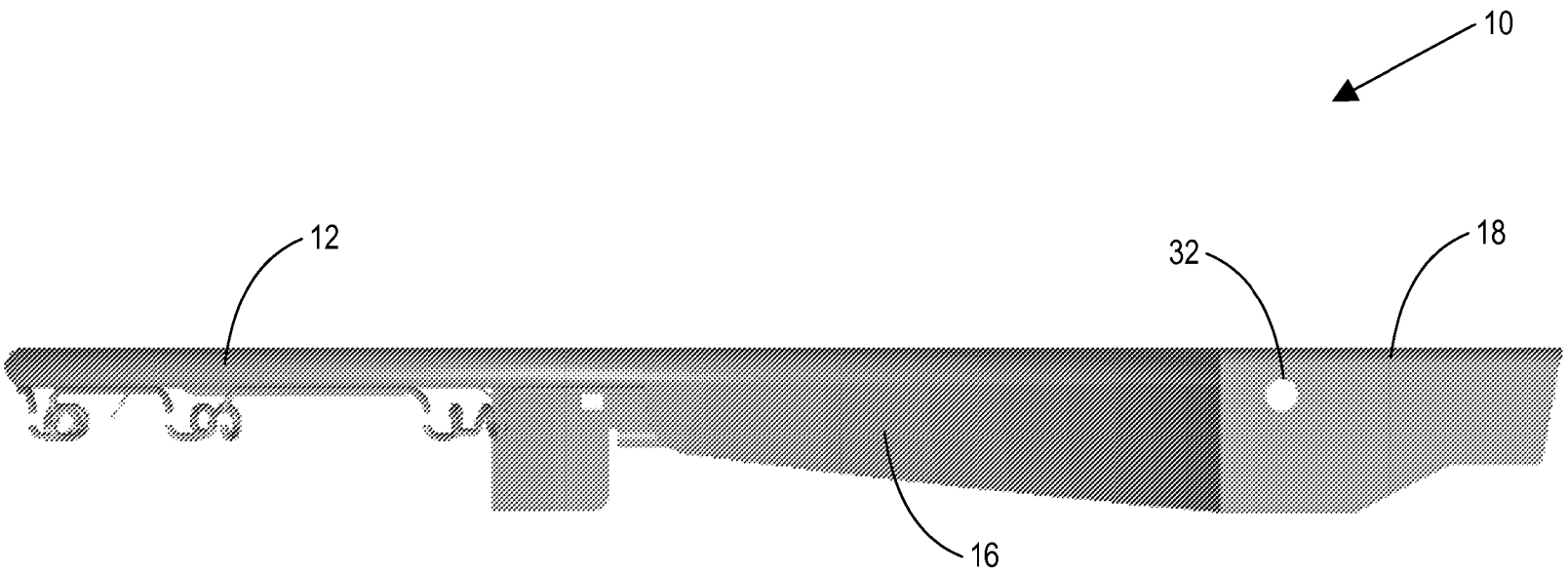
FIG. 6 is a right side view of a portion of the basketball goal.

As best seen in FIG. 5, the basketball rim assembly 10 may include a rim extension or connecting portion 18 that extends outwardly relative to the rim 12. In particular, the rim connecting portion 18 preferably extends outwardly from a rear portion of the rim 12 and the rim connecting portion is preferably connected to both the rim and the rim brace 16. In greater detail, the rim connecting portion 18 may include an upper portion or plate that is generally aligned with the upper portion of the rim 12 and the plate preferably has a length that is generally equal to the desired distance separating the rim 12 and the backboard (not shown). Additionally, the rim connecting portion 18 may include two generally downwardly extending flanges 20, 22. The generally downwardly extending flanges 20, 22 are preferably disposed on opposing sides of the plate and the flanges may help facilitate connection of the rim connecting portion, the rim 12 and/or rim brace 16. For example, the rim connecting portion 18 may be securely connected to the rim 12 and rim brace 16 by welding the plate and flanges 20, 22 to the rim and rim brace. It will be appreciated, however, that these components may be connected in any suitable manner or arrangement. Further, the generally downwardly extending flanges 20, 22 preferably have a height that is generally equal to or smaller than the combined height of the rim 12 and rim brace 16 to allow, for example, these components to be securely connected. It will be understood that the flanges 20, 22 could have any desired length and the flanges are not required.

Because the rim 12, rim brace 16 and rim connecting portion 18 are preferably securely interconnected by means such as welding, these components are preferably interconnected during the manufacturing process. Advantageously, this may help create a strong and rigid rim assembly 10 with desirable rebounding characteristics. The other components of the basketball goal 8, which are discussed in more detail below, may be connected or assembled at a subsequent time. This may allow the basketball goal 8 to be shipped in a partially unassembled configuration. For example, the rim 12, rim brace 16 and rim connecting portion 18 could be welded together at the factory and shipped with the other components of the basketball goal 8 to the retailer or consumer. It will be appreciated that the rim assembly 10 could also be formed as part of a unitary, one-piece structure, if desired. It will further be appreciated that the rim assembly 10 could have other suitable shapes, sizes, configurations and arrangements depending, for example, upon the intended use of the basketball goal 8.

In addition, the other components of the basketball goal 8 preferably do not have dimensions that are larger than the length, width or height of the rim 12, rim brace 16 and rim connecting portion 18 (which may be collectively referred to as the basketball rim assembly 10 for clarity and ease of reference). Thus, the size of the packaging and/or storage space may be determined by the dimensions of the rim 12, rim brace 16 and rim connecting portion 18 because the other components may all have a smaller size. Furthermore, the other components of the basketball goal 8 may be generally disposed within the rim assembly 10 in the shipping or storage configuration, if desired. In particular, as shown in FIG. 5, the other components of the basketball goal 8 may be disposed within the rim 12 in the shipping or storage configuration, if desired.

If the basketball goal 8 is a breakaway type rim, then the rim assembly 10 may move between the playing and displaced positions. Thus, as the rim 12 moves from the playing position to the displaced position, the rim brace 16 and rim connecting portion 18 preferably also move between first and second positions. Similarly, when the rim 12 moves from the displaced position to the playing position, the rim brace 16 and rim connecting portion 18 preferably also return to their normal positions.

As shown in FIG. 1, a rim mounting bracket 24 may help connect the rim assembly 10 to the backboard or basketball goal support structure. For example, one portion of the rim mounting bracket 24 may be connected to the backboard or basketball goal support structure, and another portion of the rim mounting bracket may be connected to the rim assembly 10. In greater detail, the rim mounting bracket 24 may include a first portion 26, which may be disposed towards a left side of the rim 12, and a second portion 28, which may be disposed towards a right side of the rim. The first and second portions 26, 28 of the rim mounting bracket 24 are preferably pivotally connected to the rim connecting portion 18 to allow, for example, the rim assembly 10 to pivot relative to the rim mounting bracket. Specifically, the first and second portions 26, 28 of the rim mounting bracket 24 may include openings 30 that are sized and configured to be aligned with openings 32 in the flanges 20, 22 of the rim connecting portion 18, for example, to receive a pivot pin, such as a bolt or other fastener. This may allow the rim connecting portion 18 and rim mounting bracket 24 to be pivotally connected. It will be appreciated that the rim connecting portion 18 and rim mounting bracket 24 may be connected in other suitable configurations and arrangements depending, for example, upon the intended use of the basketball goal 8 and/or size, shape, configuration or arrangement of the rim assembly 10.

As shown in the accompanying figures, the first and second portions 26, 28 of the rim mounting bracket 24 preferably have generally complimentary shapes and configurations. For example, the first portion 26 may include a side wall 34 and the second portion 28 may include a side wall 36. The first portion 26 of the rim mounting bracket 24 may also include a generally U-shaped portion 38 with a rear portion 40 and a generally inwardly extending flange 42, and the second portion 28 of the rim mounting bracket may similarly include a generally U-shaped portion 44 with a rear portion 46 and a generally inwardly extending flange 48.

Figure 7:
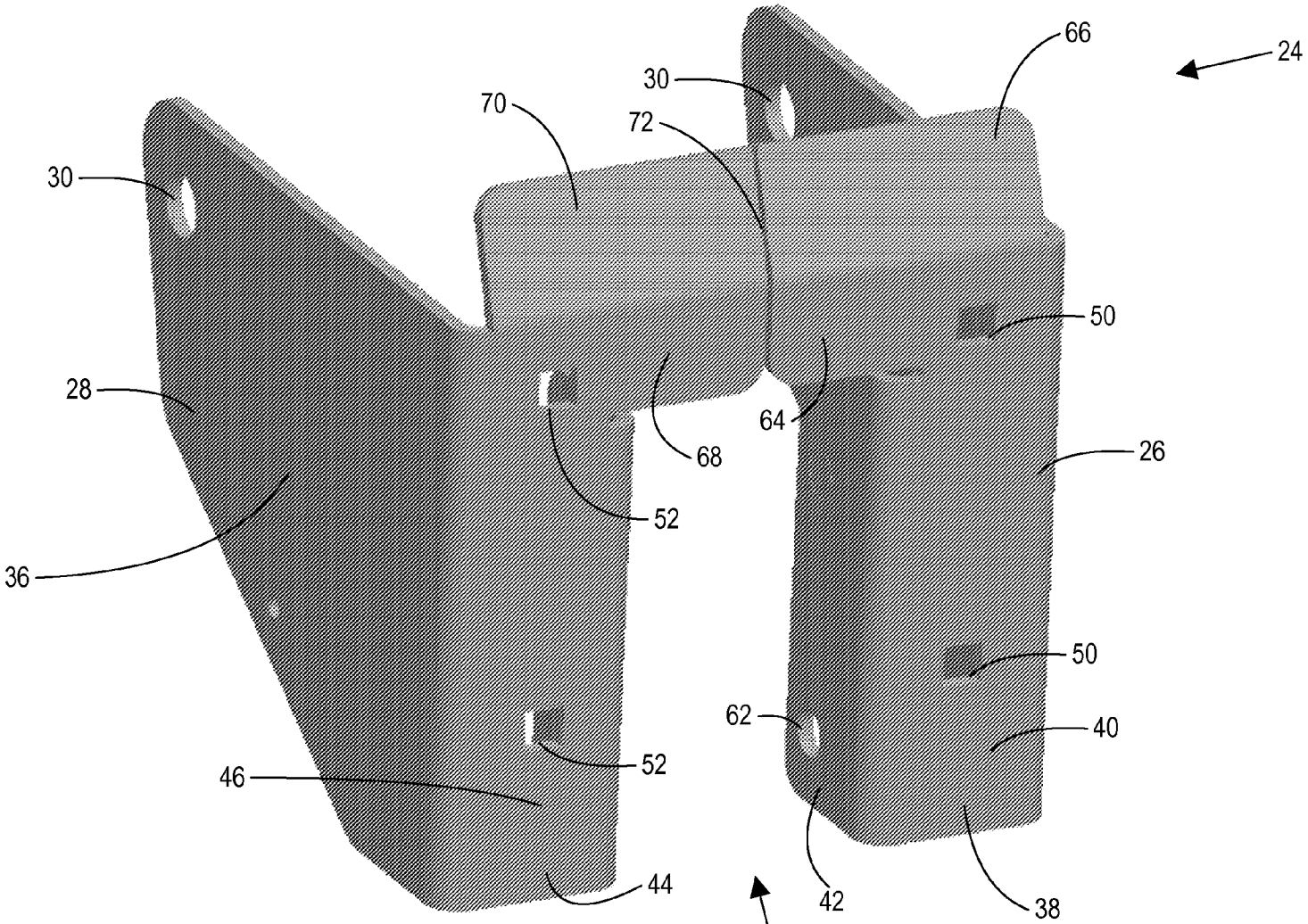
FIG. 7 is a perspective view of another portion of the basketball goal.

As best seen in FIG. 7, the rear portions 40, 46 of the rim mounting bracket 24 are preferably aligned in generally the same plane. In addition, the rear portions 40, 46 of the rim mounting bracket 24 are preferably sized and configured to be connected to the backboard or basketball goal support structure. For example, the rear portions 40, 46 of the rim mounting bracket 24 may include openings 50, 52, respectively, that are sized and configured to facilitate attachment of the rim mounting bracket 24 to a backboard or basketball goal support structure. This may allow, for example, fasteners to be inserted through the openings 50, 52 to facilitate attachment of the rim mounting bracket 24 to the backboard or basketball goal support structure.

As shown in FIG. 7, the rear portions 40, 46 of the first and second generally U-shaped portions 38, 44 of the rim mounting bracket 24 are preferably spaced apart. In particular, the rear portion 40 and the rear portion 46 are preferably separated by an opening 54. As discussed in more detail below, the opening 54 is preferably sized and configured to receive a pivot bracket 56. The pivot bracket 56 is preferably pivotally connected to the inwardly extending flanges 42, 48 of the generally U-shaped portions 38, 44 of the rim mounting bracket 24. In particular, the pivot bracket 56 may include openings 58 that are sized and configured to be generally aligned with openings 60, 62 in the generally inwardly extending flanges 42, 48 of the generally U-shaped portions 38, 44 of the rim mounting bracket 24 to facilitate attachment of the pivot bracket to the rim mounting bracket. It will be appreciated that the pivot bracket 56 may be connected to the rim mounting bracket 24 in other suitable configurations and arrangements depending, for example, upon the intended use of the basketball goal 8. It will also be appreciated that the pivot bracket 56 may be connected to other suitable portions of the rim mounting bracket 24, backboard or basketball goal support structure.

Advantageously, the rim mounting bracket 24 may consist of a unitary, one-piece component, which may be integrally formed, or it may consist of two or more pieces, which may be interconnected. For example, as best seen in FIG. 7, the first portion 26 of the rim mounting bracket 24 may include an extension 64 and a generally upwardly extending flange 66 and the second portion 28 of the rim mounting bracket may include an extension 68 and a generally upwardly extending flange 70. Desirably, the extensions 64, 68 and/or flanges 66, 70 may allow the first and second portions 26, 28 of the rim mounting bracket 24 to be integrally formed or interconnected. For instance, the extensions 64, 68 and/or flanges 66, 70 may be directly connected to form a unitary, one-piece rim mounting bracket 24. The extensions 64, 68 and/or flanges 66, 70 may also be movably connected or subsequently connected, which may help facilitate packaging and/or storage of the basketball rim assembly 10.

Advantageously, if the extensions 64, 68 and/or flanges 66, 70 are movably connected, then the rim mounting bracket 24 may be moved between a shipping or storage position and a use position, for example, between a collapsed position and an extended position. Significantly, the storage position may allow the basketball goal 8 to be more compactly packaged, shipped and stored. For example, if the rim mounting bracket 24 is formed as a unitary, one-piece structure, then the first and second portions 26, 28 may be connected along a boundary or line of demarcation 72 that separates the extensions 64, 68 and/or flanges 66, 70. Preferably, the first and second portions 26, 28 are bendable or otherwise flexibly connected so that the rim mounting bracket 24 may be shipped or stored in a more compact configuration, such as a folded position, and then bent, unfolded or otherwise moved into a use position. In particular, the rear portion 40 of the first portion 26 is preferably positioned generally parallel to and adjacent the rear portion 46 of the second portion 28 when the rim mounting bracket 24 is in the shipping or storage position. The rear portions 40, 46 of the first and second portions 26, 28, however, are preferably generally aligned when the rim mounting bracket 24 is in the use position. In addition, the side walls 34, 36 of the first and second portions 26, 28 are preferably generally aligned when in the rim mounting bracket 24 is in the shipping or storage position and preferably generally parallel when in the use position. Moreover, when the rim mounting bracket 24 is in the use position, the openings 30 in the sidewalls 34, 36 are preferably aligned to receive a pivot pin to help pivotally connect the rim connecting portion 18 and the rim mounting bracket 24, as discussed above, and the openings 30 are preferably not aligned when the rim mounting bracket is in the shipping or storage position.

On the other hand, the rim mounting bracket 24 may include two or more components that are interconnected. For example, the extensions 64, 68 and/or flanges 66, 70 may be connected by one or more hinges, fasteners and the like. Thus, the rim mounting bracket 24 may be disposed in a shipping or storage position and a use position, whether the rim mounting bracket is a single, unitary structure or multiple components that are interconnected. In addition, the first and second portions 26, 28 need not be interconnected when in the rim mounting bracket 24 is in shipping or storage position and thus the first and second portions may be shipped or stored in an unconnected configuration. Desirably, when the rim mounting bracket 24 is in the shipping or storage position, the maximum dimensions of the rim mounting bracket are generally equal to or less than the maximum dimensions of the rim assembly 10. In particular, when the rim mounting bracket 24 is in the shipping or storage position, then height, width and length of the first and second portions 26, 28 are preferably generally equal to or less than the corresponding height, width and length of the rim assembly 10. This may allow, for example, the rim mounting bracket 24 is be conveniently and compactly shipped and stored.

The rim mounting bracket 24 may also form part of a housing 74 that encloses at least a portion of the basketball goal 8. For example, the side walls 34, 36 of the rim mounting bracket 24 may form the left and right sides of the housing 74. In addition, the upper portion of the rim connecting portion 18 may form the upper portion of the housing 74. The housing 74 may further include a lower portion 76 that is connected to the side walls 34, 36 of the rim mounting bracket 24. The lower portion 76, for example, may include upwardly extending flanges and the flanges may include openings that are sized and configured to facilitate connection of the lower portion to the side walls 34, 36 of the rim mounting bracket 24. The housing 74 may cover, protect, support and/or prevent contact with at least a portion of the basketball goal 8. It will be appreciated that the housing 74 may include any suitable number of components and the housing may have a variety of suitable sizes, shapes, configurations and arrangements depending, for example, upon the intended use or design of the basketball goal 8.

In addition, the rim mounting bracket 24 may be sized and configured to facilitate movement of the rim 12 between the playing and displaced positions. For example, the generally upwardly extending flanges 66, 70 of the rim mounting bracket 24 may be sized and configured to allow the rim connecting portion 18 to move between the playing position and the displaced position. For example, if the rim 12 is displaced downwardly, then the rear portion of the rim connecting portion 18 may move upwardly. Desirably, the flanges 66, 70 are sized and configured to allow the rear portion of the rim connecting portion 18 to move upwardly.

As discussed above, a biasing member 80 may be sized and configured to allow the rim 12 to move from the playing position to the displaced position when a force greater than a given amount is applied to the rim. The biasing member 80 preferably resiliently returns the rim 12 to the playing position when the force applied to the rim is less than the given amount. The biasing member 80 may consist of one or more springs, such as compression springs, extension springs, torsion springs, leaf springs, gas springs or the like. The biasing member 80 may also consists of various types of elastic devices or other structures that are capable of returning to their initial form or state after deformation.

Figure 8:
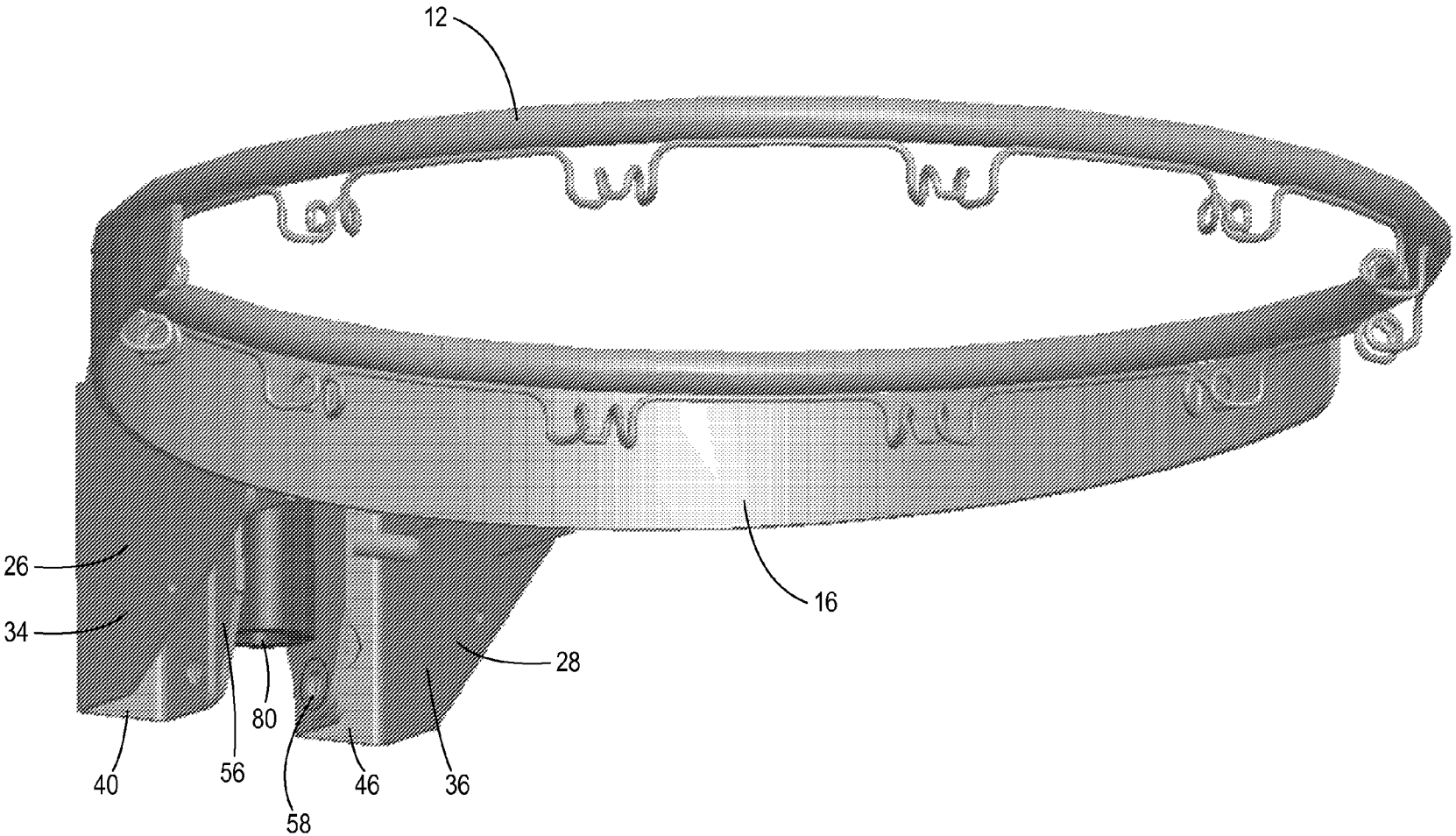
FIG. 8 is a perspective view of still another portion of the basketball goal.
Figure 9:
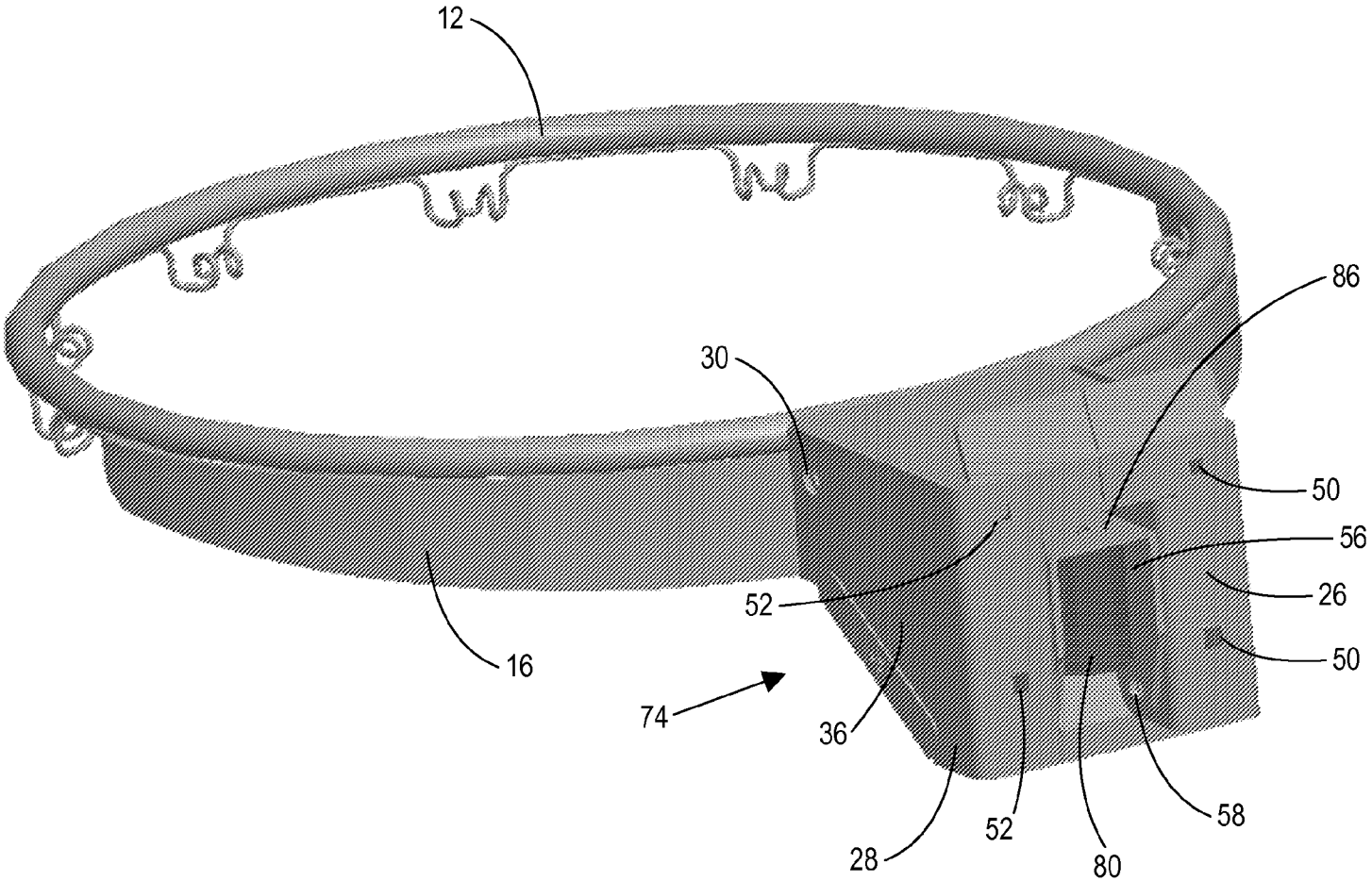
FIG. 9 is a rear perspective view of the basketball goal.
Figure 10:
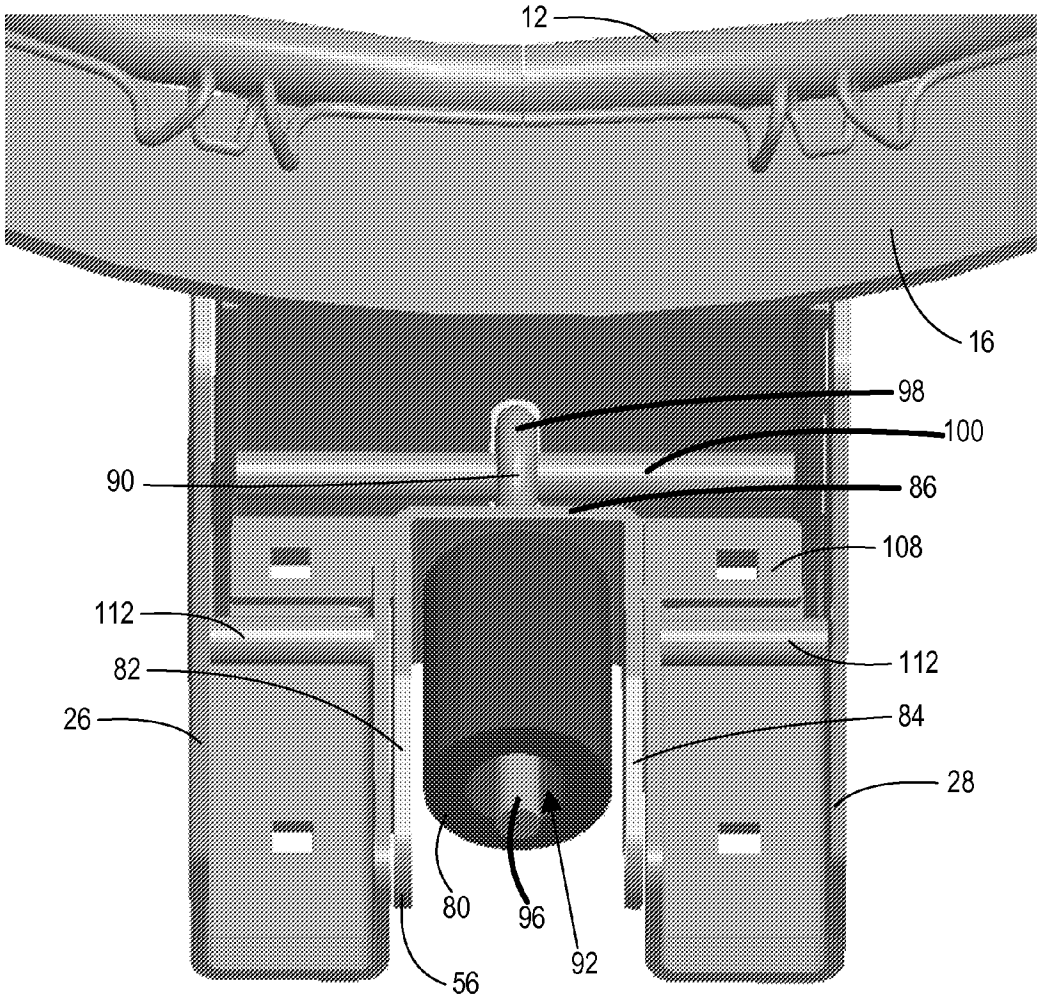
FIG. 10 is an enlarged front perspective view of another portion of the basketball goal.

As best seen in FIGS. 8-10, the biasing member 80 is preferably at least partially disposed within the pivot bracket 56. In greater detail, the pivot bracket 56 preferably has a generally U-shaped configuration with two side walls 82, 84 and an end wall 86. The biasing member 80 may be disposed between the side walls 82, 84 and an end of the biasing member may contact the end wall 86. As discussed above, one end of the pivot bracket 56 may be pivotally connected to the rim mounting bracket 24. The other end of the pivot bracket 56 is preferably movable relative to the rim mounting bracket 24.

Figure 11:
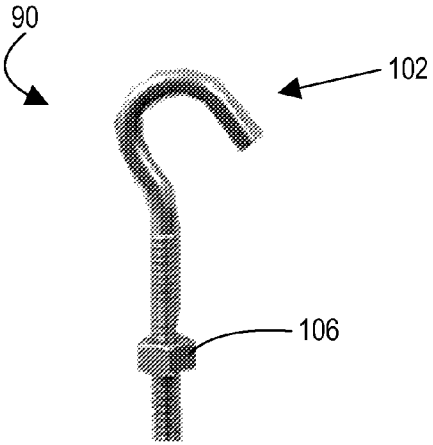
FIG. 11 is a side view of an exemplary connector that may be used in connection with the basketball goal.
Figure 12:
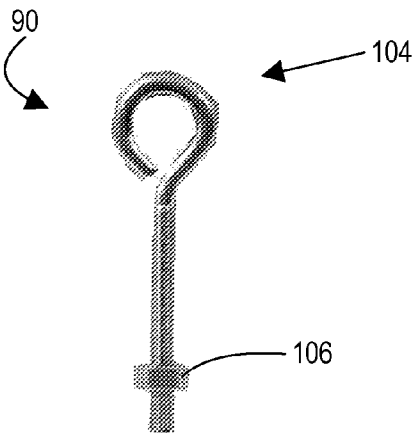
FIG. 12 is a side view of another exemplary connector that may be used in connection with the basketball goal.

The pivot bracket 56 is also preferably connected to the basketball rim assembly 10. In particular, the pivot bracket 56 is preferably connected to the rim connecting portion 18 of the basketball rim assembly 10. For example, a connector 90 may be inserted through an opening 92 in the biasing member 80 and an opening 94 in the end wall 86 of the pivot bracket 56. A first end 96 of the connector 90 may be sized and configured to engage or contact the biasing member 80 and a second end 98 of the connector may be sized and configured to engage or contact a connecting rod 100 of the rim connecting portion 18. In greater detail, the connector 90 may be a bolt with a hook-shaped portion 102 as shown in FIG. 11 or an eye bolt with a loop-shaped portion 104. The hook-shaped portion 102 or the loop-shaped portion 104 of the connector 90 is preferably connected to the connecting rod 100. An engaging member, such as the nuts 106 shown in FIGS. 11 and 12, is preferably connected to the first end 96 of the connector 90 and the engaging member is preferably sized and configured to engage the end of the biasing member 80. Advantageously, the engaging member may be adjustably connected to the connector 90, which may allow the force required to move the rim 12 from the playing position to the displaced position to be adjusted. It will be appreciated that the engaging member may have other suitable shapes, sizes, configurations and arrangements depending, for example, upon the type of biasing member 80 and/or connector 90. It will also be appreciated that the connector 90 may have other suitable shapes, sizes, configurations and arrangements depending, for example, upon the type of biasing member 80 and/or intended use of the basketball goal 8.

As discussed above, the biasing member 80 is preferably sized and configured to bias the rim 12 into the playing position and allow the rim to move into the displaced position when a force greater than a given amount is applied to the rim. Advantageously, the pivot bracket 56, biasing member 80 and connector 90 may all be at least partially or substantially disposed within the housing 74. In addition, because the pivot bracket 56 may be pivotally connected to the rim mounting bracket 24, this may allow forces applied to the pivot bracket, biasing member 80 and connector 90 to be generally aligned, regardless of the positioning of the rim assembly 10 and/or the rim 12. Significantly, because the forces on the pivot bracket 56, biasing member 80 and connector 90 may be generally aligned when the rim 12 is in the playing and displaced positions, this may significantly decrease or eliminate other forces or stresses applied to these and other components, such as torque. Because these other forces or stresses may be decreased or eliminated, that may create a more robust and long-lasting basketball goal 8. In addition, because the basketball goal 8 may be subjected to less force or stress, that may reduce the risk that various parts of the basketball goal may bend, break or otherwise be damaged.

When the basketball goal 8 is being used, the rim 12 and rim connecting portion 18 are preferably disposed in the playing position. When sufficient force is applied to the rim 12, the rim may move downwardly into the displaced position and the rear portion of the rim connecting portion 18 to move upwardly. The upward movement of the rear portion of the rim connecting portion 18 may cause the connector 90 to also move upwardly, but this movement of the connector may be resisted by the biasing member 80. The upwardly movement of the connector 90 may compress the biasing member 80 and cause the pivot bracket 56 to rotate. Advantageously, the connector 90, biasing member 80 and pivot bracket 56 may move so that the resultant force is generally aligned and directly applied to these components. When the force on the rim 12 is decreased so that it is less than the resilient force of the biasing member 80, the biasing member may resiliently return the rim to the playing position.

As shown in FIG. 10, the rim assembly 10 may also included a connector 108. The connector 108 may include openings 110 that may be aligned with an upper opening 50, 52 formed in the first and second portions 26, 28 in order to receive fasteners. For example, the openings may receive fasteners that facilitate attachment of the rim mounting bracket 24 to a backboard or a basketball goal support structure. Desirably, the connector 108 may help maintain the first and second portions 26, 28 in a desired relative position.

The rim mounting bracket 24 may include one or more stops, which may be sized and configured to limit the movement of the rim 12. In particular, as the biasing member 80 resiliently returns the rim 12 to the playing position, a portion of the rim connecting portion 18 may contact and/or engage the stops, which may help prevent the rim from moving past a desired position. For instance, the stops may help prevent the rim from moving substantially past the playing position. The stops may include, for example, rods 112 shown in FIG. 10. The stops may also include, for example, the flanges 42, 48 of the first and second portions of the rim mounting bracket 24.

Although this invention has been described in terms of certain preferred embodiments, other embodiments apparent to those of ordinary skill in the art are also within the scope of this invention.

What is claimed is:

1. A basketball goal comprising:

a rim assembly sized and configured to move between a playing position and a displaced position;

a rim mounting bracket sized and configured to be connected to a support structure so that the rim mounting bracket remains in a generally fixed position relative to a playing surface, the rim mounting bracket including a first inwardly extending flange and a second inwardly extending flange that are spaced apart by a distance, the rim assembly being pivotally connected to the rim mounting bracket to allow the rim assembly to be moved between the playing position and the displaced position;

a pivot bracket pivotally connected to the first flange and the second flange of the rim mounting bracket, the pivot bracket being disposed in a first position when the rim assembly is in the playing position and a second position when the rim assembly is in the displaced position;

a biasing member sized and configured to bias the rim assembly from the displaced position to the playing position; and a connector connecting the pivot bracket and the rim assembly, the connector being sized and configured to interconnect the biasing member, the pivot bracket and the rim assembly so that when the rim assembly is in the displaced position, a force provided by the biasing member is generally aligned with the connector and the pivot bracket;

wherein the rim mounting bracket includes a first side wall and a second side wall; and wherein the rim mounting bracket is movable from a storage position in which the first and second side walls are generally aligned in the same plane to a use position in which the first and second side walls are generally parallel.

2. The basketball goal as in claim 1, wherein the rim mounting bracket includes a first rear wall and a second rear wall;

wherein when the rim mounting bracket is in the storage position, the rear walls are disposed in a generally parallel configuration; and wherein when the rim mounting bracket is in the use position, the rear walls are generally aligned in the same plane.

3. The basketball goal as in claim 2, wherein the first flange, the first side wall and the first rear wall form a first portion of the rim mounting bracket, the second flange, the second side wall and the second rear wall form a second portion of the rim mounting bracket, the first and second portions of the rim mounting bracket being integrally formed as part of a unitary, one-piece structure.

4. The basketball goal as in claim 2, wherein the first flange, the first side wall and the first rear wall form a first portion of the rim mounting bracket, the second flange, the second side wall and the second rear wall form a second portion of the rim mounting bracket, the first and second portions of the rim mounting bracket being pivotally interconnected.

5. The basketball goal as in claim 2, wherein the first flange, the first side wall and the first rear wall form a first portion of the rim mounting bracket, the second flange, the second side wall and the second rear wall form a second portion of the rim mounting bracket; and wherein the pivot bracket is sized and configured to be pivotally connected to and at least partially disposed between the first and second portions of the rim mounting bracket.

6. The basketball goal as in claim 1, wherein the first flange, the first side wall and the first rear wall form a first portion of the rim mounting bracket, the second flange, the second side wall and the second rear wall form a second portion of the rim mounting bracket, the first and second portions of the rim mounting bracket having a generally U-shaped configuration.

7. The basketball goal as in claim 6, wherein the pivot bracket is sized and configured to be pivotally connected to and at least partially disposed between the first and second portions of the rim mounting bracket.

8. A basketball rim assembly comprising:

a rim mounting bracket comprising:

a first portion having a generally U-shaped configuration with a sidewall, a rear wall and a flange; and a second portion having a generally U-shaped configuration with a sidewall, a rear wall and a flange;

a rim assembly including a rim, a rim brace and a rim connecting portion, the rim assembly pivotally connected to the rim mounting bracket, the rim assembly movable between a playing position and a displaced position;

an opening disposed between the flange of the first portion of the rim mounting bracket and the flange of the second portion of the rim mounting bracket;

a pivot bracket at least partially disposed within the opening, the pivot bracket pivotally connected to the flange of the first portion and the flange of the second portion of the rim mounting bracket, the pivot bracket movable between a first position when the rim assembly is in the playing position and a second position when the rim assembly is in the displaced position;

a biasing member that is sized and configured to bias the rim assembly into the playing position, the biasing member at least partially disposed within the opening; and a connector connecting the pivot bracket, biasing member and the rim assembly.

9. The basketball rim assembly as in claim 8, wherein the biasing member includes a first portion connected to the connector and a second portion connected to the pivot bracket.

10. The basketball rim assembly as in claim 9, wherein when a force applied to the rim assembly is sufficient to overcome a biasing force provided by the biasing member, the rim assembly moves from the playing position to the displaced position and the pivot bracket rotates from the first position to the second position.

11. The basketball rim assembly as in claim 8, wherein the pivot bracket has a generally U-shaped configuration with a first sidewall connected to the flange of the first portion of the rim mounting bracket and a second sidewall connected to the flange of the second portion of the rim mounting bracket.

12. The basketball rim assembly as in claim 11, wherein the biasing member is disposed between the first sidewall and the second sidewall of the generally U-shaped pivot bracket.

13. The basketball rim assembly as in claim 8, wherein a rear portion of the rim connecting portion and the connector moves upwardly and forwardly relative to the rim mounting bracket when the rim assembly moves from the playing position to the displaced position; and wherein the pivot bracket rotates forwardly when the rim assembly moves from the playing position to the displaced position.

14. The basketball rim assembly as in claim 8, wherein the biasing member is disposed between a first end of the connector and the pivot bracket.

15. The basketball rim assembly as in claim 8, wherein the biasing member and the connector are at least partially disposed within the pivot bracket.

16. The basketball rim assembly as in claim 8, wherein the sidewall of the first portion of the rim mounting bracket and the sidewall of the second portion of the rim mounting bracket are generally aligned in the same plane when the rim mounting bracket is in a storage position; and wherein the sidewall of the first portion of the rim mounting bracket and the sidewall of the second portion of the rim mounting bracket are disposed in generally parallel planes then the rim mounting bracket is in use position.

17. The basketball rim assembly as in claim 8, wherein the first portion of the rim mounting bracket includes a first extension and the second portion of the rim mounting bracket includes a second extension, the first extension and the second extension defining at least a portion of the opening disposed between the first portion and the second portion of the rim mounting bracket, the pivot bracket being at least partially disposed in the opening.

18. The basketball rim assembly as in claim 8, wherein the rear wall of the first portion of the rim mounting bracket is sized and configured to contact and abut a first portion of a basketball backboard; and wherein the rear wall of the second portion of the rim mounting bracket is sized and configured to contact and abut a second portion of the basketball backboard.

19. The basketball rim assembly as in claim 8, wherein the rim mounting bracket is sized and configured to be attached to a support structure so that the rim mounting bracket remains in a generally fixed position.

20. A basketball rim assembly comprising:

a first rim mounting bracket having a generally U-shaped configuration with a sidewall, a rear wall and a flange;

a second rim mounting bracket having a generally U-shaped configuration with a sidewall, a rear wall and a flange;

an aperture disposed between the flange of the first rim mounting bracket and the flange of the second rim mounting bracket;

a rim assembly pivotally connected to the sidewall of the first rim mounting bracket and the sidewall of the second rim mounting bracket, the rim assembly movable between a playing position and a displaced position;

a pivot bracket at least partially disposed within the aperture between the flange of the first rim mounting bracket and the flange of the second rim mounting bracket, the pivot bracket pivotally connected to the flange of the first rim mounting bracket and the flange of the second rim mounting bracket, the pivot bracket movable between a first position when the rim assembly is in the playing position and a second position when the rim assembly is in the displaced position;

a connector connecting the pivot bracket and the rim assembly; and a biasing member that is sized and configured to bias the rim assembly into the playing position;

wherein the rim mounting bracket is movable between a storage position in which the sidewall of the first rim mounting bracket is generally aligned in the same plane with the sidewall of the second rim mounting bracket and a use position in which the sidewall of the first rim mounting bracket is disposed generally parallel to the sidewall of the second rim mounting portion.

21. A basketball rim assembly comprising:

a rim mounting bracket including a first portion with a sidewall, a rear wall and inwardly extending flange, the rim mounting bracket including a second portion with a sidewall, a rear wall and an inwardly extending flange;

an aperture disposed between the first flange and the second flange of the rim mounting bracket;

a rim assembly pivotally connected to the rim mounting bracket, the rim assembly movable between a playing position and a displaced position;

a pivot bracket at least partially disposed within the aperture between the first flange and the second flange of the rim mounting bracket, the pivot bracket pivotally connected to the first flange and the second flange of the rim mounting bracket, the pivot bracket movable between a first position when the rim assembly is in the playing position and a second position when the rim assembly is in the displaced position;

a connector connecting the pivot bracket and the rim assembly; and a biasing member sized and configured to bias the rim assembly into the playing position.

* * * * *

UNITED STATES PATENT AND TRADEMARK OFFICE

CERTIFICATE OF CORRECTION

PATENT NO. : 7,604,555 B2
APPLICATION NO. : 11/679748
DATED : October 20, 2009
INVENTOR(S) : Nye It is certified that error appears in the above-identified patent and that said Letters Patent is hereby corrected as shown below:

Column 3
Line 27, change "maintains" to --maintain--

Column 5
Line 22, change "FIG. 1 a" to --FIG. 1 is a--

Column 10
Line 40, change "is" to --to--

Signed and Sealed this

Sixteenth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,604,555 B2
APPLICATION NO. : 11/679748
DATED : October 20, 2009
INVENTOR(S) : S. Curtis Nye It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 36 days.

Signed and Sealed this

Fifth Day of October, 2010

David J. Kappos

David J. Kappos
*Director of the United States Patent and Trademark Office*